US008405376B2

(12) United States Patent
Hwang et al.

(10) Patent No.: US 8,405,376 B2
(45) Date of Patent: Mar. 26, 2013

(54) LOW NOISE REFERENCE CIRCUIT OF IMPROVING FREQUENCY VARIATION OF RING OSCILLATOR

(75) Inventors: In-chul Hwang, Seoul (KR); Myung-woon Hwang, Seongnam (KR); Je-cheol Moon, Seoul (KR); Hyun-ha Jo, Seoul (KR)

(73) Assignee: FCI Inc., Gyeonggi-Do (KR)

( * ) Notice: Subject to any disclaimer, the term of this patent is extended or adjusted under 35 U.S.C. 154(b) by 684 days.

(21) Appl. No.: 12/625,428

(22) Filed: Nov. 24, 2009

(65) Prior Publication Data

US 2010/0134087 A1 Jun. 3, 2010

(30) Foreign Application Priority Data

Dec. 1, 2008 (KR) ..... 10-2008-0120264

(51) Int. Cl.
*G05F 3/16* (2006.01)

(52) U.S. Cl. ..... 323/314; 323/281; 323/315; 323/907

(58) Field of Classification Search ..... 323/281, 323/313, 314, 315, 907
See application file for complete search history.

(56) References Cited

U.S. PATENT DOCUMENTS

| | | | | |
|---|---|---|---|---|
| 5,144,223 | A * | 9/1992 | Gillingham | 323/313 |
| 5,512,817 | A * | 4/1996 | Nagaraj | 323/316 |
| 6,323,628 | B1 * | 11/2001 | Park | 323/281 |
| 6,737,908 | B2 * | 5/2004 | Mottola et al. | 327/539 |
| 6,919,753 | B2 * | 7/2005 | Wang et al. | 327/513 |
| 2008/0315855 | A1 * | 12/2008 | Xiao et al. | 323/313 |
| 2010/0134087 | A1 * | 6/2010 | Hwang et al. | 323/313 |
| 2011/0068766 | A1 * | 3/2011 | Nag et al. | 323/313 |
| 2012/0094613 | A1 * | 4/2012 | Zhong et al. | 455/73 |

* cited by examiner

*Primary Examiner* — Jeffrey Sterrett

(57) ABSTRACT

A low noise reference voltage circuit without using an amplifier inside is capable of transforming a current $I_{PTAT}$ in positive proportion to absolute temperature into a voltage $V_{PTAT}$ in positive proportion to absolute temperature, and outputting it to a ring oscillator. The low noise reference voltage circuit improves a degradation of noise performance compared with a conventional band-gap reference voltage circuit and is in characteristic of low noise and higher PSRR.

5 Claims, 6 Drawing Sheets

LOW NOISE REFERENCE CIRCUIT OF IMPROVING FREQUENCY VARIATION OF RING OSCILLATOR

CLAIM OF PRIORITY

This application claims priority to Korean Patent Application No. 10-2008-0120264 filed on Dec. 1, 2008.

FIELD OF THE INVENTION

The present invention relates to a low noise reference voltage circuit, and more particularly, to a low noise reference voltage circuit without using an amplifier inside which is capable of transforming a current $I_{PTAT}$ in positive proportion to absolute temperature into a voltage $V_{PTAT}$ in positive proportion to absolute temperature, and outputting it to a ring oscillator, thereby improving a degradation of noise performance compared with a conventional band-gap reference voltage circuit and being in characteristic of low noise and higher power supply rejection ratio (PSRR).

BACKGROUND OF THE INVENTION

In general, a complementary metal oxide semiconductor (CMOS) ring oscillator has a wider modulation region without using a larger manual device, thereby is used widely in the applications such as wireless communication. Currently, with the development of the CMOS technology, the CMOS ring oscillator is used in the RF applications such as broadcasting tuners, GPS receivers and wireless LAN transceivers (WLAN).

However, the noise performance of the CMOS ring oscillator is weaker, and thus it has limitations, such as the problem of high sensitivity for the variation of temperature and power supply.

Currently, for solving the problem of high sensitivity for the changed rate of temperature and power supply, a band-gap reference voltage circuit which provides a modulated reference voltage according to the variation of temperature and power supply to the ring oscillator is supplied. That is, when the temperature increases, the frequency of the ring oscillator decreases, and the band-gap reference voltage circuit in positive proportion to the temperature is used to raise the frequency thereof for temperature compensation.

Refer to FIG. 1. FIG. 1 is a block diagram showing a ring oscillator of a conventional band-gap reference voltage circuit generating an oscillation signal.

Referring to FIG. 1 again, a band-gap reference voltage circuit 10, a linear regulator 20, a ring oscillator 30 and a level shifter 40 are shown, wherein the band-gap reference voltage circuit 10 provides a reference voltage by using an external applied power supply, and the linear regulator 20 regulates and outputs the reference voltage according to a constant voltage, and the ring oscillator 30 oscillates and generates a pulse train according to the regulated reference voltage, and the level shifter 40 shifts the pulse train which is generated by the ring oscillator 30 according to a constant level, and outputs it.

The band-gap reference voltage circuit 10 includes an amplifying terminal using the external power voltage to performing amplifying, and provides the reference voltage ($V_{REF}$) according to the output value of the amplifying terminal. At this time, for temperature compensation, the reference voltage ($V_{REF}$) generated by the band-gap reference voltage circuit 10 has a value which varies according to the slope of a temperature coefficient (TC).

That is, for compensating the frequency of the ring oscillator which is decreased due to the increased temperature, the band-gap reference voltage circuit 10 with positive-TC increases the reference voltage ($V_{REF}$), thereby increasing the voltage ($V_{DDO}$) applied to the ring oscillator.

The linear regulator 20 receives the reference voltage ($V_{REF}$) generated by the band-gap reference voltage circuit 1 for temperature compensation, and outputs the reference voltage ($V_{REF}$) in the constant voltage ($V_{DDO}$) with a constant ratio.

The ring oscillator 30 is composed of an odd number of inverters which are connected in a ring-shape, and is driven by the constant voltage ($V_{DDO}$) of the linear regulator 20, thereby outputting the pulse train with a constant frequency. At this time, the ring oscillator 30 uses the reference voltage ($V_{REF}$), which is generated after temperature compensation, to generate an oscillation clock for compensating the frequency.

The level shifter 40 appropriately shifts a direct current (DC) voltage level of the signal generated by the ring oscillator 30 and outputs to the RF receiver including the ring oscillator 30.

The band-gap reference voltage circuit with positive-TC has an output noise of low level and PSRR of high level. However, since the ring oscillator is sensitive to the variation of the driving voltage ($V_{DDO}$), the band-gap reference voltage circuit 10 is sensitive to 1/f noise and thermal noise, and has the problem of a degradation of noise performance. Furthermore, the noise performance will directly impact the ring oscillator 30. Therefore, the frequency of the ring oscillator 30 is varied by the variation of temperature and power supply, resulting in the problem that the oscillation signal can not be generated accurately.

Again, since the band-gap reference voltage circuit 10 includes the amplifying terminal, it results in a noise amplification phenomenon that the current and the voltage therein are amplified at the same time, thereby worsening the noise performance.

SUMMARY OF THE INVENTION

Therefore, an aspect of the present invention is to provide a band-gap reference voltage circuit which is capable of comparing with and amplifying the current varying with temperature and the current not varying with temperature, thereby reducing the frequency variation for temperature compensation. The circuit is a low noise reference voltage circuit without using an amplifier inside which is capable of transforming a current in positive proportion to absolute temperature into a PTAT (proportional to absolute temperature) voltage in positive proportion to absolute temperature, and outputting it to a driving voltage of a ring oscillator, thereby improving a degradation of noise performance compared with a conventional band-gap reference voltage circuit and being in characteristic of low noise and higher PSRR.

According to one embodiment of the present invention, the low noise reference voltage circuit for improving the frequency variation of a ring oscillator comprises a PTAT current generating unit, a PTAT voltage transforming unit, and a PSRR improving resistor. The PTAT current generating unit is configured to generate a PTAT current in positive proportion to absolute temperature. The PTAT voltage transforming unit is configured to transform the PTAT current into a PTAT voltage and to output the PTAT voltage to a linear regulator, wherein the PTAT voltage transforming unit includes a transistor of a current mirror and a diode connected thereto. The PSRR improving resistor is connected to one terminal of the transistor and configured to improve the variation of a power voltage.

Therefore, with the use of the low noise reference voltage circuit disclosed in the present invention, a current in positive proportion to absolute temperature can be transformed into a PTAT voltage for being a driving voltage of a ring oscillator, thereby being in characteristic of low noise and higher PSRR. Furthermore, since there is no amplifier in the reference voltage circuit, the area of thereof can be minimized, and the minimum number of transistors is used to generate a reference voltage which is insensitive to temperature and power variation.

BRIEF DESCRIPTION OF THE DRAWINGS

The foregoing aspects and many of the attendant advantages of this invention will become more readily appreciated as the same becomes better understood by reference to the following detailed description, when taken in conjunction with the accompanying drawings, wherein.

DETAILED DESCRIPTION OF THE PREFERRED EMBODIMENT

In order to make the illustration of the present invention more explicit and complete, the following description is stated with reference to FIG. 2 through FIG. 6.

Figure 1:
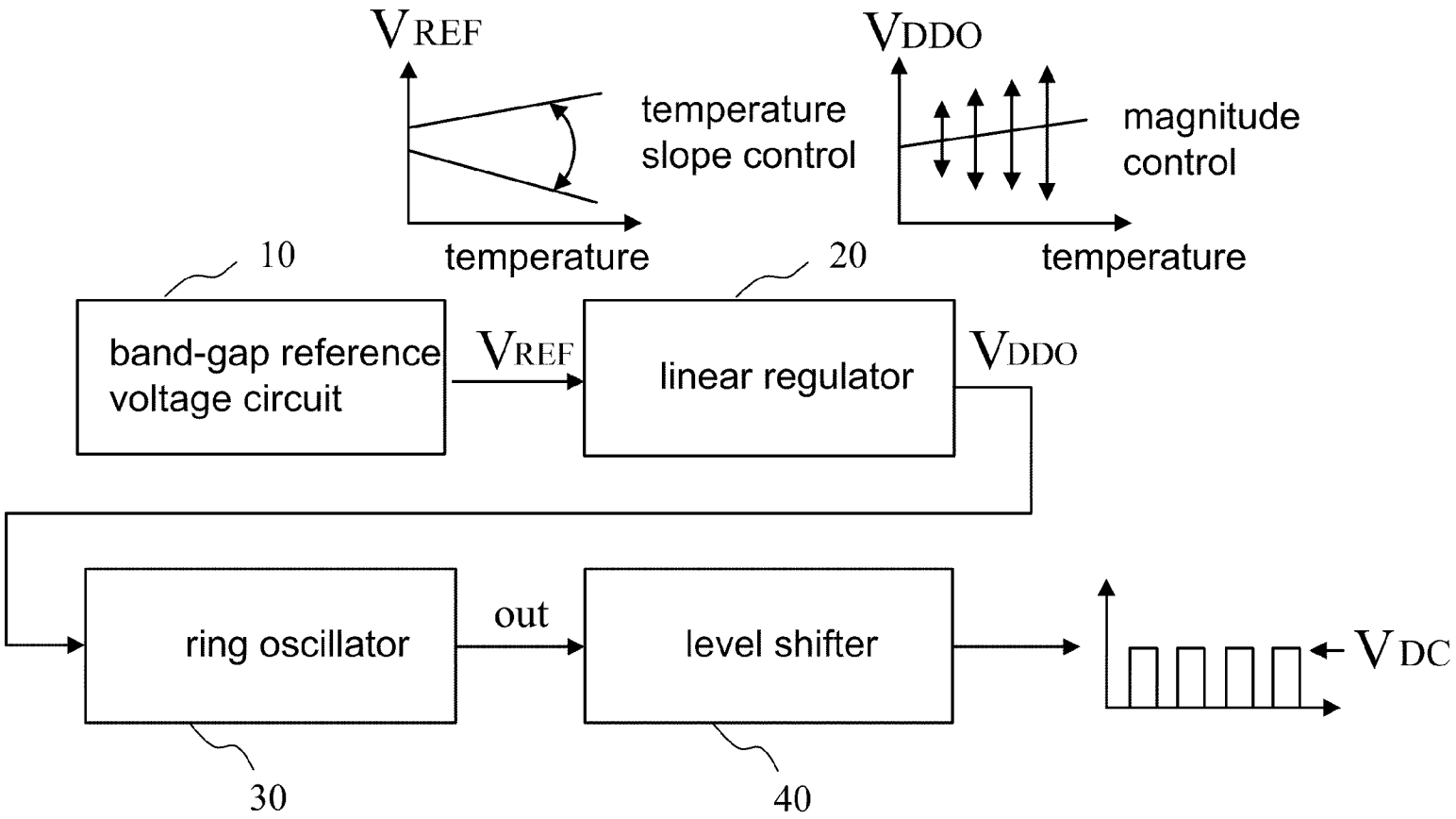
Fig. 1 Prior Art
FIG. 1 is a block diagram showing a ring oscillator of a conventional band-gap reference voltage circuit generating an oscillation signal.
Figure 2:
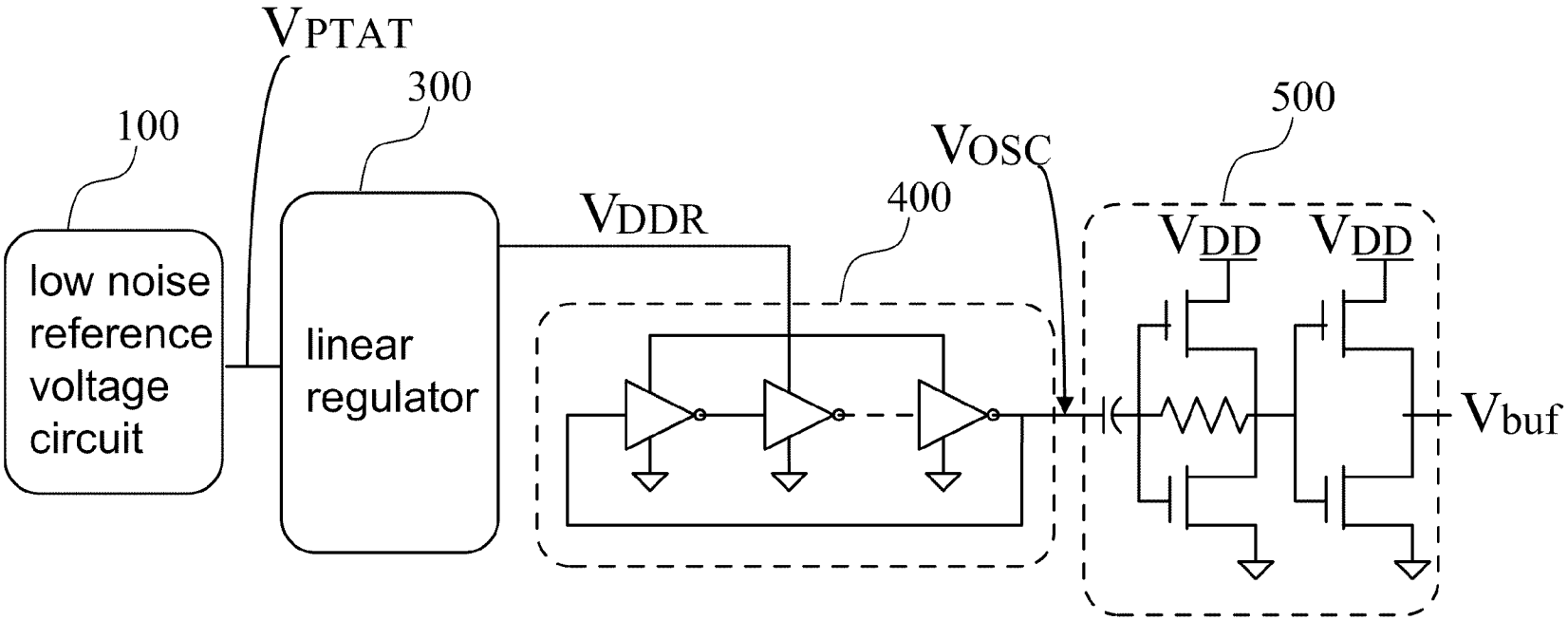
FIG. 2 is a block diagram showing a ring oscillator of a low noise reference voltage circuit generating an oscillation signal according to the present invention.

Referring to FIG. 2, presented herein is a block diagram showing a ring oscillator of a low noise reference voltage circuit generating an oscillation signal according to the present invention.

Referring to FIG. 2 again, for using the low noise reference voltage circuit to allow the ring oscillator generating the oscillation signal, the invention comprises the low noise reference voltage circuit 100, a linear regulator 300, the ring oscillator 400 and level shifter 500. The low noise reference voltage circuit 100 transforms an external power supply into a PTAT voltage ($V_{PTAT}$) for being provided to a reference voltage. The linear regulator 300 receives the PTAT voltage ($V_{PTAT}$) and outputs a constant voltage ($V_{DDR}$) with a constant ratio. The ring oscillator 400 uses the outputted voltage ($V_{DDR}$) of the linear regulator 300 to perform oscillation and to generate a pulse train ($V_{OSC}$) with a constant frequency. The level shifter 500 shifts a direct current (DC) voltage level of the pulse train generated by the ring oscillator 400 and outputs a voltage ($V_{buf}$).

The present invention relates to a new reference voltage circuit which provides a stable driving power to a CMOS ring oscillator for performing oscillation. Therefore, the linear regulator 300, the CMOS ring oscillator 400 and the level shifter 500, which are configured to generate the oscillation signal, can be identical to conventional structures, and are not mentioned for simplification. Description below explains the structure of the low noise reference voltage circuit 100 without using an amplifying terminal, wherein the low noise reference voltage circuit 100 can be in characteristic of low noise and higher PSRR and generate the PTAT voltage ($V_{PTAT}$) which is not sensitive to the variation of temperature and power voltage.

Figure 3:
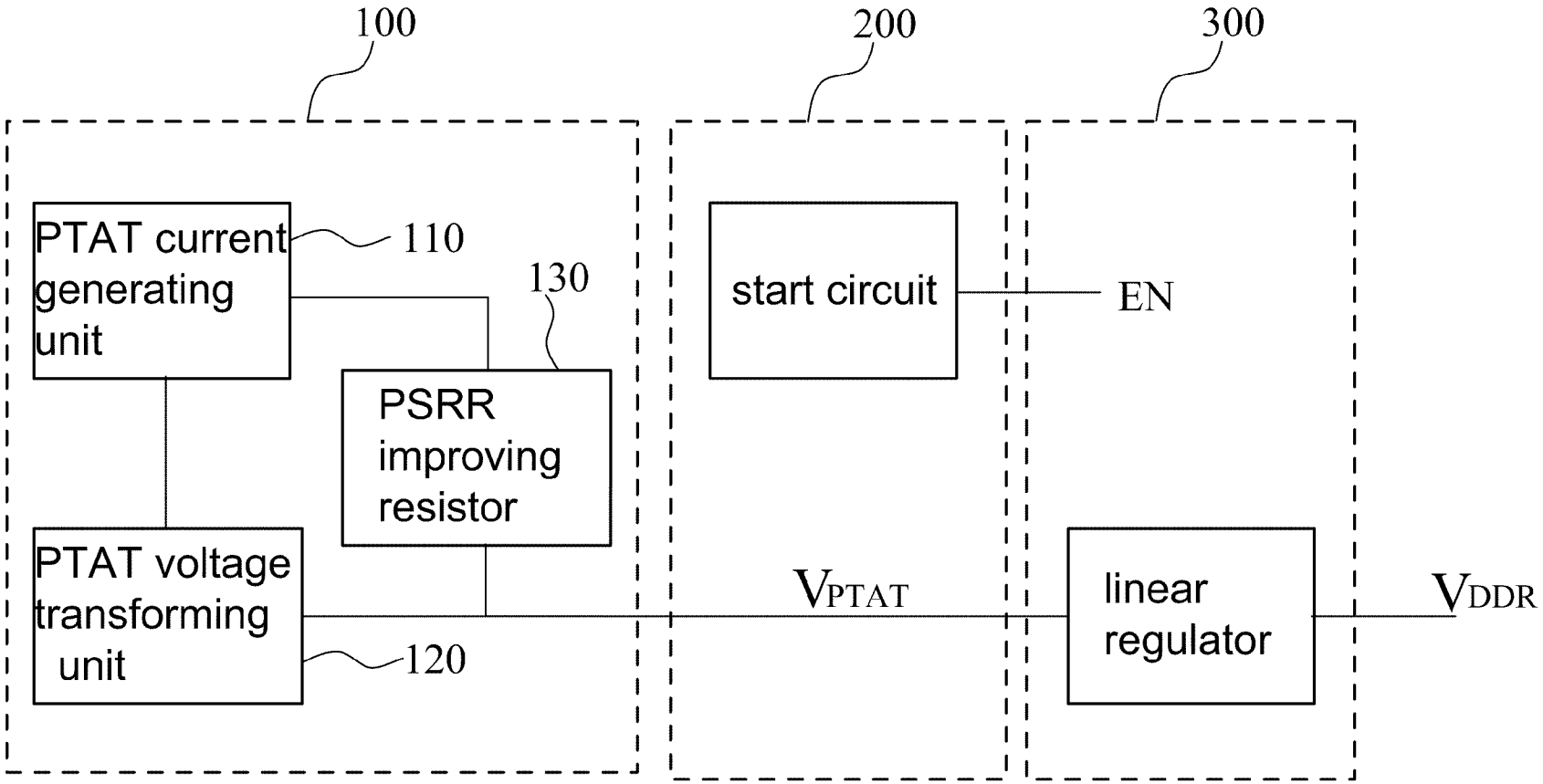
FIG. 3 is a block diagram showing the low noise reference voltage circuit according to the present invention.
Figure 4:
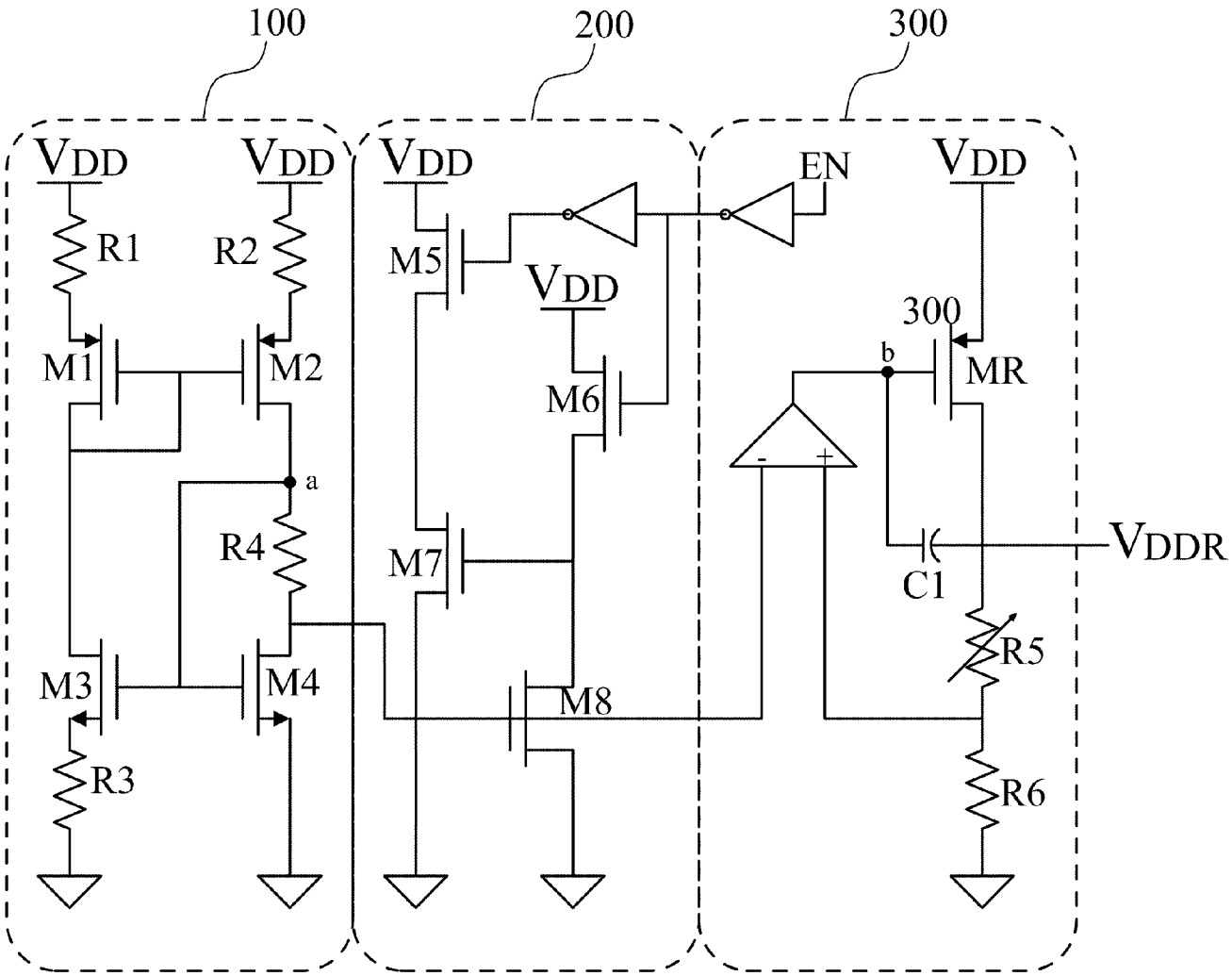
FIG. 4 is a circuit diagram showing the low noise reference voltage circuit according to the present invention.

Referring to FIG. 3 and FIG. 4, FIG. 3 is a block diagram showing the low noise reference voltage circuit according to the present invention, and FIG. 4 is a circuit diagram showing the low noise reference voltage circuit according to the present invention.

Referring to FIG. 3 and FIG. 4 again, the low noise reference voltage circuit 100 comprises a PTAT current generating unit 110, a PTAT voltage transforming unit 120, a PSRR improving resistor 130, a start circuit 200 and the linear regulator 300. The PTAT current generating unit 110 is configured to generate a PTAT current ($I_{PTAT}$) in positive proportion to absolute temperature. The PTAT voltage transforming unit 120 is configured to transform the PTAT current into the PTAT voltage ($V_{PTAT}$). The improving resistor 130 is configured to the variation of a power voltage ($V_{DD}$). The start circuit 200 is configured to drive the low noise reference voltage circuit 100 according to the constant voltage. The linear regulator 300 is configured to regulate the PTAT voltage ($V_{PTAT}$) generated by the low noise reference voltage circuit 100.

For generating the PTAT current ($I_{PTAT}$) with low noise and capable of being compensated with the temperature variation, the PTAT current generating unit 110 is composed of CMOS PTAT current generators with positive TC.

Referring to FIG. 4 again, the PTAT current generating unit 110 includes a first degeneration resistor R1, a second degeneration resistor R2, a first positive channel metal oxide semiconductor (PMOS) M1 and a second PMOS M2. One terminal of the first degeneration resistor R1 and One terminal of the second degeneration resistor R2 are connected to the power voltage ($V_{DD}$). One terminal of the first PMOS M1 is connected to the first degeneration resistor R1. One terminal of the second PMOS M2 is connected to the second degeneration resistor R2. The first PMOS M1 and the second PMOS M2 form a current mirror.

The PTAT current generating unit 110 further includes the PMOS M1 and M2 of the current mirror, a first negative channel metal oxide semiconductor (NMOS) M3 and a second NMOS M4. One terminal of the NMOS M3 is connected to another terminal of the first PMOS M1. One terminal of the second NMOS M4 is connected to another terminal of the second PMOS M2 by using the PSRR improving resistor (R4) 130. Preferably, the first PMOS M1 and the second PMOS M2 are constructed of 1:1 amplification parameter ratio, and the first NMOS M3 and the second NMOS M4 are constructed of k2:1 amplification parameter ratio.

Furthermore, the gates of the first PMOS M1 and the second PMOS M2 are connected to each other, and are connected to another terminal of the first PMOS M1. The gates of the first NMOS M3 and the second NMOS M4 are also connected to each other, and are connected to a connecting node (a) between another terminal of the second PMOS M2 and the PSRR improving resistor (R4) 130.

That is, for reducing the 1/f noise resulting from the PMOS M1 and M2 and increase resistance of the output node, the first degeneration resistor R1 is connected between the power voltage ($V_{DD}$) and another terminal of the first PMOS M1, and the second degeneration resistor R2 is connected between the power voltage ($V_{DD}$) and another terminal of the second PMOS M2. Furthermore, a resistor R3 is connected between another terminal of the first NMOS M3 and a ground power, and another terminal of the second NMOS M4 is connected to the ground power.

At this time, when a channel-length modulation effect is omitted, branch currents of the current mirror, which is composed of the first NMOS M3, the second NMOS M4 and the resistor R3, can be calculated according to the Equation 1 below.

$$I(M_4) = \left(\frac{k-1}{k}\right)^2 \cdot \frac{2}{\mu_n C_{OX}(W/L)_3 R_3^2} \quad \text{[Equation 1]}$$

As shown in the Equation 1, temperature varies with the changed rate in a power law of −1.5. Therefore, the PTAT current ($I_{PTAT}$), which is independent to the power voltage provided by the current mirror and has positive TC, is generated.

The PTAT voltage transforming unit 120 is composed of the second NMOS M4 connected to a diode. The gate of the second NMOS M4 is connected to the connecting node (a) between one terminal of the second PMOS M2 and the PSRR improving resistor (R4) 130.

As shown in the Equation 2, the second NMOS M4 connected to the diode can transform the PTAT current ($I_{PTAT}$) of the PTAT current generating unit 110 into the PTAT voltage ($V_{PTAT}$) without using an operation amplifier (OP AMP), and generate the reference voltage (i.e. the PTAT voltage $V_{PTAT}$) for temperature compensation.

$$V_{PTAT} = \left(\frac{k-1}{k}\right) \cdot \frac{2}{\mu_n C_{OX}\left(\frac{W}{L}\right)_3 R_3} \cdot \left(1 - \left(\frac{k-1}{k}\right)\frac{R_4}{R_3}\right) + V_{TH} \quad \text{[Equation 2]}$$

For allowing the second NMOS M4 outputting the transformed PTAT voltage ($V_{PTAT}$), the connecting node between a drain terminal of the second NMOS M4 and another terminal of the PSRR improving resistor (R4) 130 is connected to an inverting terminal of an operation amplifier of the linear regulator 300.

Furthermore, since the variation of the power voltage ($V_{DD}$) results in that the current variation in the second PMOS M2 is transformed into the PTAT voltage ($V_{PTAT}$), a sensitivity to the power voltage ($V_{DD}$) of the PTAT voltage ($V_{PTAT}$) will be raised without using the PSRR improving resistor (R4) 130.

Again, the PSRR improving resistor (R4) 130 for reducing the sensitivity is connected between one terminal of the second PMOS M2 and one terminal of the second NMOS M4. At this time, for preventing the current variation from being transmitted to the variation of the PTAT voltage ($V_{PTAT}$) and improving the power variation, preferably, the PSRR improving resistor (R4) 130 is designed to be 1/gm. At this time, the electrical conductivity of the second NMOS M4 is determined by the gm value. Therefore, a higher PSRR can be obtained.

Furthermore, in the linear regulator 300, the transformed PTAT voltage ($V_{PTAT}$) in the PTAT voltage transforming unit 120 is applied to the inverting terminal, and the distributed voltage of a variable resistor R5 and a resistor R6, which are connected to one terminal of a transistor MR, is applied to a non-inverting terminal, and an output terminal includes the operation amplifier connecting to a gate of the transistor MR.

At this time, a capacitor C1 is connected between one terminal and the gate (node b) of the transistor MR, and a driving voltage ($V_{DDR}$) is provide to the ring oscillator 400 through a connecting node between one terminal of the transistor MR and one terminal of the capacitor C1, thereby oscillating the frequency which varies with temperature and the power voltage.

Furthermore, referring to FIG. 4 again, the start circuit 200 is configured to apply a driving signal to the low noise reference voltage circuit, and can be formed by a conventional start circuit using an external activation signal (EN) to start driving.

Figure 5:
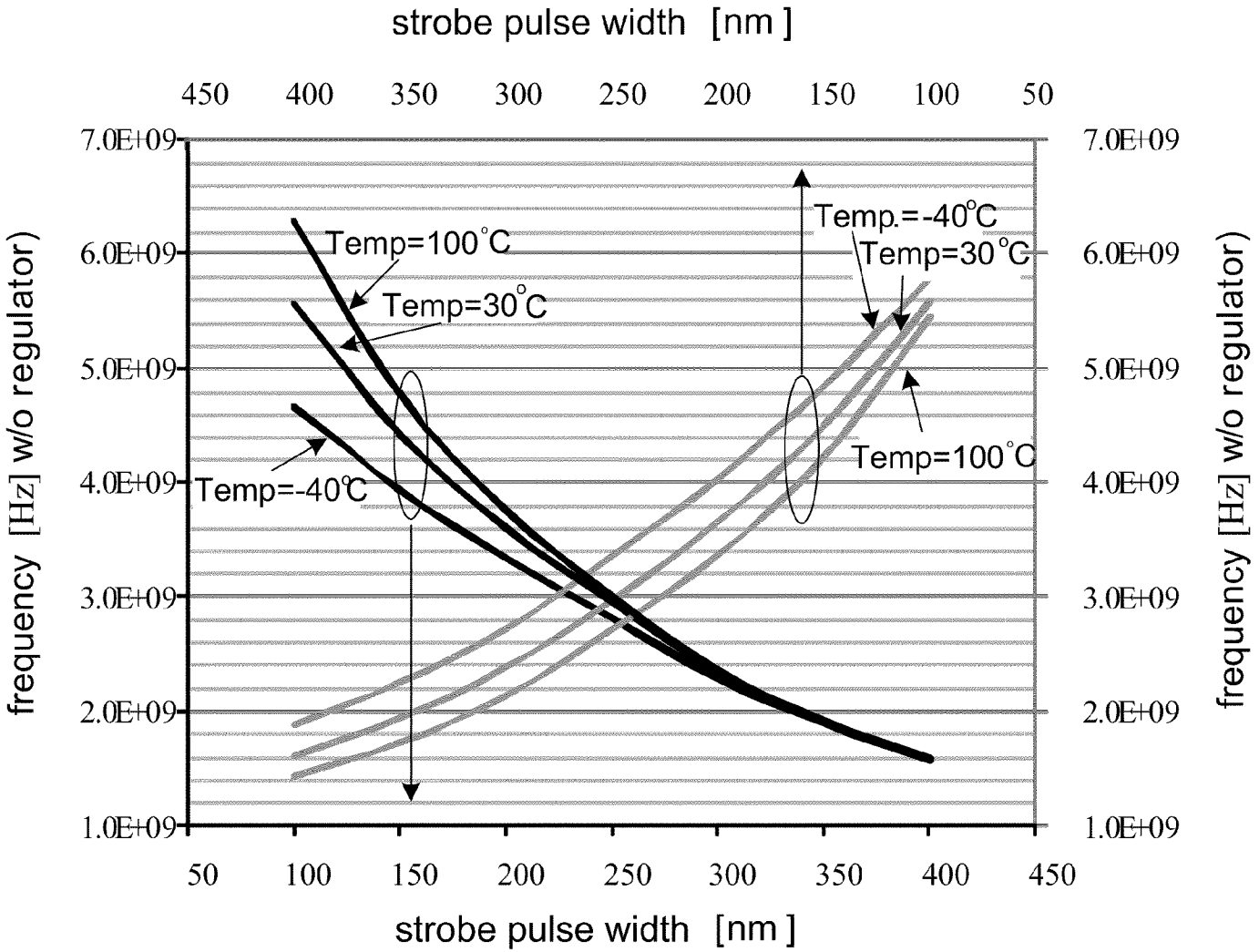
FIG. 5 shows a comparison of frequency variation compensation with different temperature.
Figure 6:
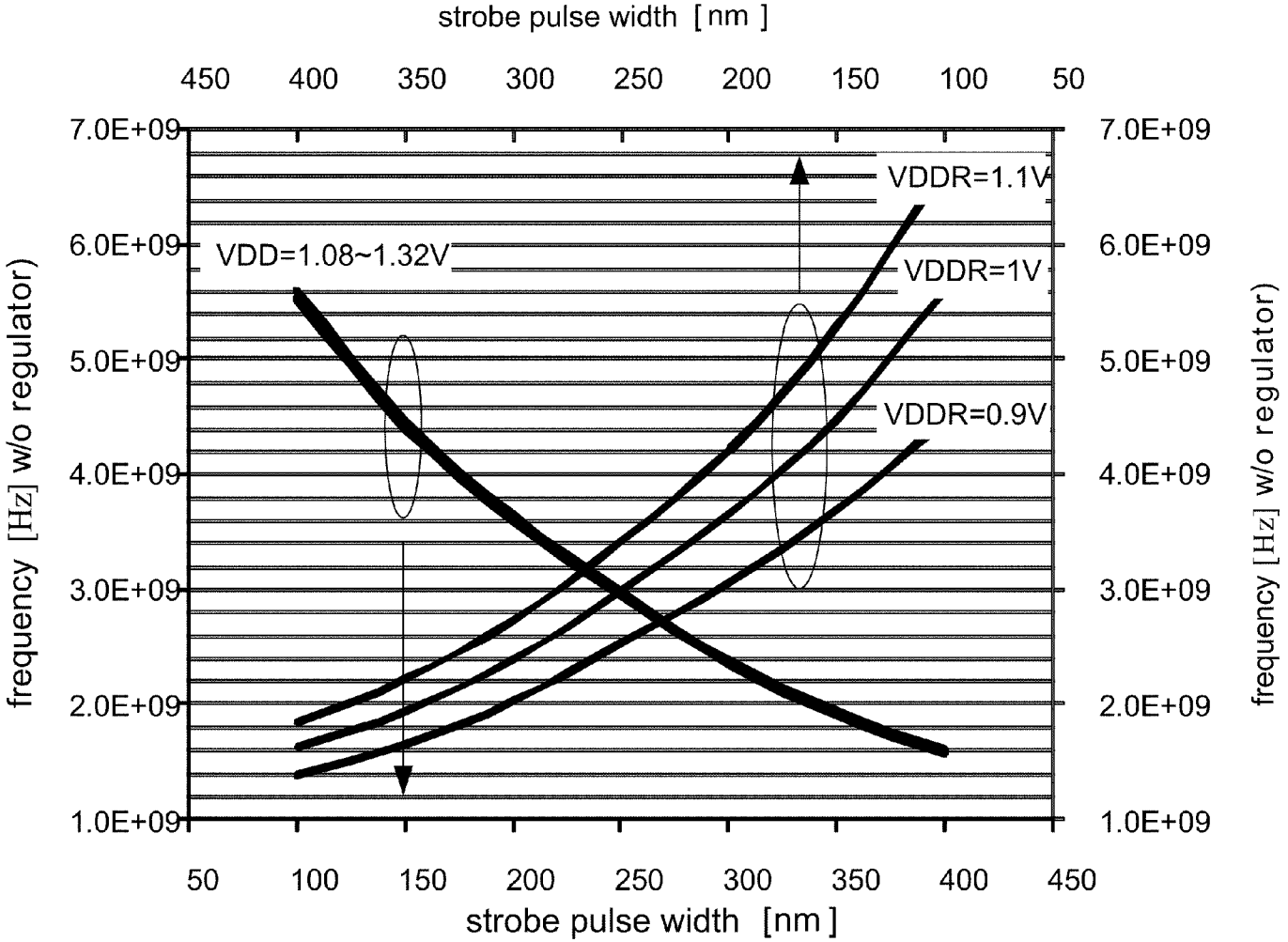
FIG. 6 shows a comparison of frequency variation compensation with different power voltages.

Referring to FIG. 5 and FIG. 6, description below explains a result of an analog experiment using the low noise reference voltage circuit according to the present invention to perform oscillation.

Referring to FIG. 5 and FIG. 6 again, FIG. 5 shows a comparison of frequency variation compensation with different temperature, and FIG. 6 shows a comparison of frequency variation compensation with different power voltages.

The above-mentioned analog experiment uses a 90 nm CMOS technique of Taiwan Semiconductor Manufacturing Company (TSMC) to proceed. As shown in FIG. 5 and FIG. 6, experimental results of the low noise reference voltage circuit capable of generating the PTAT voltage ($V_{PTAT}$) according to the present invention (illustrated as w/regulator, and the downward arrowhead represents that the results correspond to the left side and the lower side of diagrams), and experimental results of a conventional band-gap reference voltage circuit (illustrated as w/o regulator, and the upward arrowhead represents that the results correspond to the right side and the upper side of diagrams) are compared and shown therein. According to the results of the simulated experiment, the frequency variation is detected under a final pulse train which is oscillated by the ring oscillator and generated by the level shifter.

Furthermore, the ring oscillator used in the simulated experiment is suitable to a GPS application of 1.5 GHz frequency band for better temperature compensation and power compensation when the frequency is less than 2 GHz. According to an applied RF application, an appropriate frequency band is achieved for temperature and power compensation.

As shown in FIG. 5, in a case of utilizing the conventional band-gap reference voltage circuit, comparing to a curve with 30° temperature and in a region with frequency less than $2.0\times10^9$ Hz, when temperature is raised to 100°, the frequency outputted from the level shifter is reduced, and when temperature is reduced to −40°, the frequency outputted from the level shifter is raised.

On the contrary, in a case of utilizing the low noise reference voltage circuit of the present invention, comparing to a curve with 30° temperature and in a region with frequency less than $2.0\times10^9$ Hz, no matter whether temperature is raised to 100° or reduced to −40°, the frequency outputted from the level shifter is identical.

Therefore, the low noise reference voltage circuit of the present invention without using an amplifier is capable of generating the PTAT voltage ($V_{PTAT}$) for temperature compensation, and providing it to the ring oscillator, thereby performing more stable compensation for temperature in the CMOS ring oscillator.

Furthermore, referring to FIG. 6 again, in a case of utilizing the conventional band-gap reference voltage circuit, comparing to a curve with the voltage $V_{DDR}$ of 1V, which is provided to the ring oscillator according to the variation of the power voltage, and in a region with frequency less than $2.0\times10^9$ Hz, when the voltage $V_{DDR}$ provided to the ring oscillator is reduced to 0.9V, the frequency is reduced, and when the voltage $V_{DDR}$ is raised to 1.1V, the frequency is raised.

On the contrary, in a case of utilizing the low noise reference voltage circuit of the present invention, and in a region with frequency less than $2.0\times10^9$ Hz, since there is no amplifier in the low noise reference voltage circuit for generating the PTAT voltage, the effect of the variation of the power voltage can be reduced and prevented from being delivered to the ring oscillator, even if the voltage $V_{DDR}$ provided to the low noise reference voltage circuit is varied in a region of 1.08~1.32V. Therefore, the frequency variation resulted from the variation of the power voltage can be compensated more stably.

As is understood by a person skilled in the art, the foregoing embodiments of the present invention are strengths of the present invention rather than limiting of the present invention. It is intended to cover various modifications and similar arrangements included within the spirit and scope of the appended claims, the scope of which should be accorded the broadest interpretation so as to encompass all such modifications and similar structures.

What is claimed is:

1. A low noise reference voltage circuit for improving the frequency variation of a ring oscillator, comprising:

a PTAT (proportional to absolute temperature) current generating unit configured to generate a PTAT current in positive proportion to absolute temperature;

a PTAT voltage transforming unit configured to transform the PTAT current into a PTAT voltage and to output the PTAT voltage to a linear regulator, wherein the PTAT voltage transforming unit includes a transistor of a current mirror; and a power supply rejection ratio (PSRR) improving resistor connected to one terminal of the transistor and configured to improve the variation of a power voltage.

2. The low noise reference voltage circuit as claimed in claim 1, wherein the PTAT current generating unit comprises:

a first degeneration resistor, wherein one terminal of the first degeneration resistor is connected to the power voltage;

a second degeneration resistor, wherein one terminal of the second degeneration resistor is connected to the power voltage;

a first positive channel metal oxide semiconductor (PMOS), wherein one terminal of the first PMOS is connected to the first degeneration resistor; and a second PMOS, wherein one terminal of the second PMOS is connected to the second degeneration resistor, and the first PMOS and the second PMOS form another current mirror;

wherein, one terminal of a first negative channel metal oxide semiconductor (NMOS) is connected to another terminal of the first PMOS, and another terminal of the first NMOS is connected to a ground power through a resistor, and one terminal of a second NMOS is connected to another terminal of the second PMOS.

3. The low noise reference voltage circuit as claimed in claim 2, wherein a drain of the second NMOS is connected to an inverting terminal of an operation amplifier of a linear regulator.

4. The low noise reference voltage circuit as claimed in claim 2 or 3, wherein the PSRR improving resistor is connected between another terminal of the second PMOS and the drain of the second NMOS.

5. The low noise reference voltage circuit as claimed in claim 4, wherein the resistance value of PSRR improving resistor is determined by a reciprocal of the electrical conductivity of the second NMOS.

* * * * *